US007757448B2

(12) United States Patent
Zhu

(10) Patent No.: US 7,757,448 B2
(45) **Date of Patent: *Jul. 20, 2010**

(54) ASSEMBLAGE CONCRETE FORMS AND METHOD FOR MANUFACTURING THEREOF

(76) Inventor: Qinjiang Zhu, No. 57, Long Island Villa, No. 3558, North Kunming Road, Minxing District, Shanghai (CN) 201111

( * ) Notice: Subject to any disclaimer, the term of this patent is extended or adjusted under 35 U.S.C. 154(b) by 944 days.

This patent is subject to a terminal disclaimer.

(21) Appl. No.: 11/550,171

(22) Filed: Oct. 17, 2006

(65) Prior Publication Data

US 2007/0094973 A1 May 3, 2007

(30) Foreign Application Priority Data

| | | |
|---|---|---|
| Oct. 17, 2005 | (CN) | 2005 1 0200616 |
| Aug. 15, 2006 | (CN) | 2006 2 0200693 U |
| Aug. 15, 2006 | (CN) | 2006 2 0200694 U |
| Aug. 15, 2006 | (CN) | 2006 2 0200695 U |
| Aug. 15, 2006 | (CN) | 2006 2 0200696 U |
| Aug. 15, 2006 | (CN) | 2006 2 0200697 U |
| Aug. 15, 2006 | (CN) | 2006 2 0200699 U |
| Aug. 15, 2006 | (CN) | 2006 2 0200700 U |
| Aug. 15, 2006 | (CN) | 2006 2 0200704 U |

(51) Int. Cl.
*E04C 1/00* (2006.01)

(52) U.S. Cl. ..... 52/309.12; 52/309.11; 52/742.1; 52/745.05

(58) Field of Classification Search ..... 52/268, 52/309.11, 309.12, 273, 275, 742.1, 742.14, 52/745.05

See application file for complete search history.

(56) References Cited

U.S. PATENT DOCUMENTS

| | | | | |
|---|---|---|---|---|
| 3,788,020 | A * | 1/1974 | Gregori | 52/309.12 |
| 4,698,947 | A * | 10/1987 | McKay | 52/309.12 |
| 5,450,700 | A * | 9/1995 | Hackman | 52/425 |
| 6,681,539 | B2 * | 1/2004 | Yost et al. | 52/309.11 |
| 6,898,908 | B2 * | 5/2005 | Messenger et al. | 52/268 |

* cited by examiner

*Primary Examiner*—Basil Katcheves
(74) *Attorney, Agent, or Firm*—Matthias Scholl P.C.; Matthias Scholl

(57) ABSTRACT

Taught herein is inter alia a concrete wall modulus comprising a concrete-steel wall having one or more steel mesh plates; at least two form panels being physically connected to the concrete-steel wall; a plurality of steel plates; and a plurality of jointing pieces; wherein the form panels are made in part of polystyrene foam; at least two form panels are arranged in parallel to one another; and at least two the form panels are interconnected by a plurality of the jointing pieces by means of the steel plates.

27 Claims, 11 Drawing Sheets

ASSEMBLAGE CONCRETE FORMS AND METHOD FOR MANUFACTURING THEREOF

BACKGROUND OF THE INVENTION

1. Field of the Invention

This invention relates to a composite thermally-insulated concrete wall moduli comprised of pre-fabricated form panels, and a method for manufacturing thereof.

2. Description of the Related Art

Higher energy costs and worries about the environmental impact of global warming have lead to an overall increase in construction of energy-saving buildings, and specifically to the development of various energy-saving technologies for building construction, with the emphasis on the improvement of the thermal insulating properties of walls, roofs, doors and windows.

Conventional buildings are constructed using the structure-first-thermal-insulation-second-and-decoration-last approach, wherein external and internal multi-layered insulations are often employed. However, separate steps for producing and installing the insulation layers unnecessarily prolong the construction process resulting in an increase of construction costs and a decrease in the reliability of buildings.

To solve these shortcomings, Chinese Pat. No. CN1570304 discloses a thermally-insulated concrete system, wherein a thermally-insulating material is provided in the form of inner and outer insulation panels formed inseparably from and simultaneously with a concrete wall. In this manner, the separate construction and affixture of the thermal insulation layer is avoided, and the cost of construction is largely reduced.

However, despite its advantages, this improved construction system suffers from inefficiency problems because the concrete is poured sectionally and in multiple phases during the construction process. Accordingly, much opportunity for improvement remains so as to shorten the construction period, improve the strength and stability of the construction structure, and accommodate customizations.

SUMMARY OF THE INVENTION

In view of the above-described opportunities, it is one objective of the present invention to provide a composite thermally-insulated concrete wall modulus comprised of pre-fabricated form panels, and a method for manufacturing thereof, with the purpose of solving the technical problems involved in rapid construction of energy-saving factory-constructed buildings and improving further the strength and stability of one-piece monolithic moduli of composite, thermally-insulated concrete walls.

In accordance with one embodiment of the present invention provided is a composite thermally-insulated concrete wall modulus comprising a concrete-steel wall having one or more steel mesh plates; at least two form panels being physically connected to the concrete-steel wall; a plurality of steel plates and a plurality of jointing pieces; wherein the form panels are made in part or entirely of polystyrene foam; at least two the form panels are arranged in parallel to one another; and at least two of the form panels are interconnected by a plurality of jointing pieces by means of steel plates.

In certain embodiments of the invention, each steel plate comprises a main board and two side boards, the side boards having a plurality of teeth and a jointing cavity disposed on each of the teeth.

In certain embodiments of the invention, the jointing pieces pass through the jointing cavities.

In certain embodiments of the invention, the jointing pieces are interconnected by a plurality of transverse and vertical connecting locks.

In certain embodiments of the invention, the main board is coplanar with one surface of the form panel; and the side boards protrude out of the form panel.

In certain embodiments of the invention, the form panels serve as thermally-insulating layers.

In certain embodiments of the invention, the steel mesh plates are disposed between two interconnected form panels.

In certain embodiments of the invention, the steel mesh plates are physically connected to the form panels by means of concrete.

In certain embodiments of the invention, the form panels further comprise tenoned peripheral edges.

In certain embodiments of the invention, the length of each of the form panels is between about 900 and about 1500 mm, the height of each of the form panels is between about 250 and about 600 mm, and the thickness of each of the form panels is between about 40 and about 60 mm.

In certain embodiments of the invention, the steel plates have a "Π"-shaped or "U"-shaped cross section.

In certain embodiments of the invention, the modulus further comprises a plurality of stiffening ribs, wherein the stiffening ribs physically connect the side boards with the main board of the steel plate.

In certain embodiments of the invention, the side boards protrude out of the form panels to a distance of not less than 15 mm.

In certain embodiments of the invention, the steel plates further comprise a plurality of main board cavities adapted for receiving rivets which main board cavities are distributed along the main boards of the steel plates.

In certain embodiments of the invention, each the jointing piece is of "]"-shape and has a curved hook at each of its ends.

In certain embodiments of the invention, the transverse connecting lock is rod-like shaped having two grooves at positions corresponding to the two jointing pieces to be joined.

In certain embodiments of the invention, the vertical connecting lock is rod-like shaped having a plurality of grooves at positions corresponding to the jointing pieces to be joined.

In other aspects of this invention, provided is a form panel for a concrete wall modulus comprising polystyrene foam and a plurality of steel plates, wherein the steel plates comprise each a main board and two side boards, the side boards having a plurality of teeth and a jointing cavity disposed on each the tooth; the steel plates have a "Π"-shaped or "U"-shaped cross section; the main board is coplanar with a surface of the form panel; and the side boards protrude out of the form panel.

In accordance with the invention, thermally-insulating material is manufactured into structural form panels, which remain in place in the finished product so as to serve directly as the inner and outer thermal insulation surfaces of the wall after the concrete has been poured and has set in the space between the form panels.

The concrete wall and the thermal insulation layers are formed simultaneously during the construction process. In this manner, not only a separate construction of thermal insulation layers is eliminated but also the separation of the wall form the panels is avoided, and as a result, the cost of construction is largely reduced.

The wall form panels are interconnected, in certain embodiments pairwise, by a plurality of jointing pieces, which are then interconnected by transverse and vertical connecting locks. The assembly is easy and fast, the control on the dimensions is accurate, and the integral stability is high, which are beneficial qualities leading to an increase of the overall strength and stability of the structure, a higher resistance to cracking and a greater ability to withstand earthquakes.

The design of the wall is monolithically integrated, and the production and assembly is modularized. The construction quality and the construction period can be controlled precisely. The factory construction of concrete buildings is realized, and the on-site installation does not require wet conditions.

The wall form panels remain in place after concrete has been poured into the space between them; the construction speed is fast, and it not only conforms to the requirements of energy saving buildings, but also increases largely the thermal and sound insulation capabilities of the wall.

The form panel modulus of the present invention is thermally and acoustically insulated, exhibits high impermeability to water, and features the advantages of full factory construction, easy on-site assembly, and easy parameter customization, such as the customization of the wall thickness, etc.

The moduli according to the present invention are used, in certain embodiments, in the construction of high-rise buildings and are well-suited for such constructions.

BRIEF DESCRIPTION OF THE DRAWINGS

Preferred embodiments of the present invention will hereinafter be described in more detail with reference to the accompanying drawings, in which.

Figure 1:
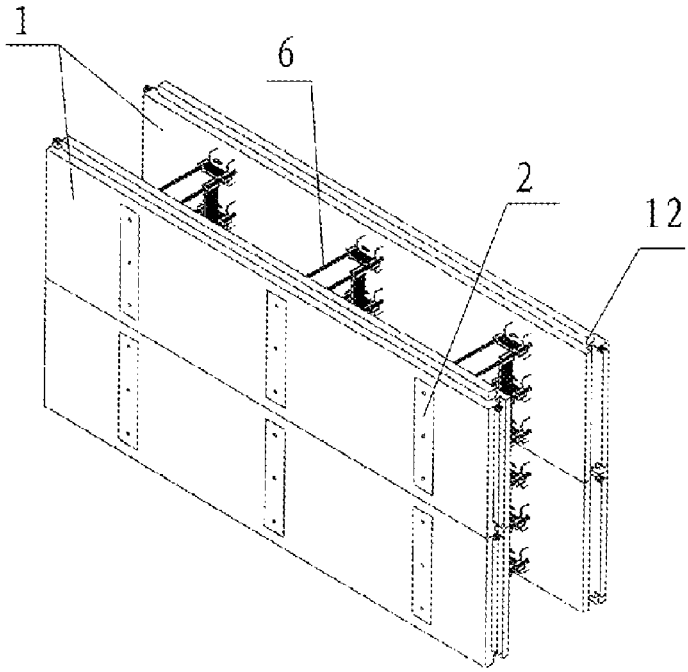
FIG. 1 illustrates an assembly of prefabricated form panels in accordance with one embodiment of the present invention.

The reference numbers of the various parts shown in the drawings are listed below, in which: (prefabricated) form panel corresponds to the number 1; steel plate—2; tooth—3; jointing cavity—4; main board cavity—5; jointing piece 6; stiffening rib—7; transverse connecting lock—8; vertical connecting lock—9; concrete—10; steel mesh plate—11; tenon—12; self-adhesive fiber cloth—13, first layer of cement mortar—14; metal mesh—15; second layer of cement mortar—16; outer-facing layer—17; inner-facing layer—18; rivet—19; anchor point—20; 135°-angle steep plate—21; stiffening rib of a 135°-angle steel plate—211; cavity—212; pulling hole—213; small raised profile—214; big raised profile—215; 90° steel plate—22; hook edge—221; 135°-angle form panel—23; straight wall form panel—24; rivet—25; thin wall C-shaped steel plate—26; slab form panel—27; 90° side form panel—28; 135° side form panel—29; internal angle—30; external angle—31; side form panel at balcony raising position—32; hanger hole—33; drilled "⊏"-shaped thin steel plate—34; passage—35; groove—36; drilled hole—37; small hook edge—38; and polystyrene foam thermal insulating material—39.

DETAILED DESCRIPTION OF THE INVENTION

With reference to FIG. 1, a plurality of steel plates 2 pre-embedded in pre-fabricated form panels 1 are interconnected by a plurality of jointing pieces 6 whereby defining a space for receiving poured concrete between the panels. The peripheral edges of the prefabricated form panels comprise tenons 12 for interconnecting one form panel to another. The vertical joints of the form panels in different layers are staggered with each other (in FIG. 1 two pairs of panels are shown stacked on top of one another). The prefabricated form panel has a length between 900 and 1500 mm, and particularly 1200 mm; a height of between 250 and 600 mm, and particularly 300 mm; and a thickness of between 40 and 60 mm, and particularly 40 mm. The grooves of the transverse and vertical connecting locks are matched with the jointing pieces.

Figure 2:
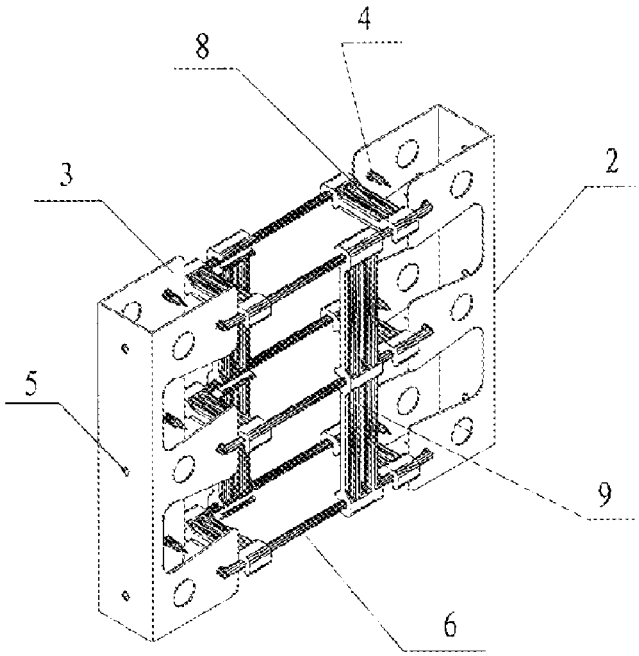
FIG. 2 illustrates a plate in accordance with one embodiment of the present invention.
Figure 3:
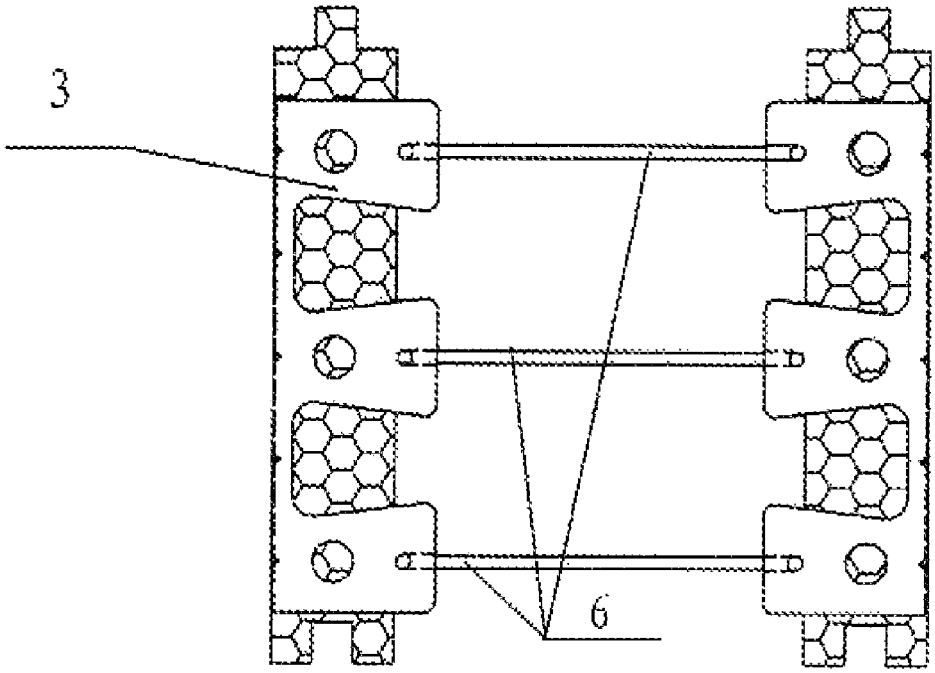
FIG. 3 illustrates a cross-sectional view of prefabricated form panels in accordance with one embodiment of the present invention.
Figure 4:
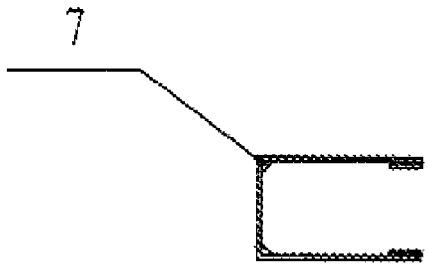
FIG. 4 illustrates a top plan view of a steel plate in accordance with one embodiment of the present invention.

FIGS. 2-4 illustrate the structure and elements of a steel plate disposed between and jointing two opposed form panels. A steel plate comprises a main board and two side boards. The side boards of the steel plates are in the shape of teeth. A jointing cavity 4 is formed on each tooth 3 for receiving a jointing piece 6, and thereby, for interconnecting the opposed form panels. A pair of jointing pieces 6 serves to interconnect the steel plates 2 at the same relative height (e.g., the two top jointing pieces in FIG. 2). This pair of jointing pieces is interconnected by a plurality of transverse connecting locks 8. It is preferred that the transverse connecting locks are disposed as near as possible to the jointing cavity. In addition, jointing pieces at different relative heights are interconnected by a plurality of vertical connecting locks 9. It is preferred that the vertical connecting locks are disposed closer to the middle section of the jointing pieces.

With reference to FIGS. 1-4, a plurality of steel plates 2 is vertically pre-embedded in each form panel. The main board of a steel plate is coplanar with a front surface of the form panel, while the two side boards of the steel plate protrude out of the other front surface of the form panel for a distance of not less than 15 mm (FIG. 3).

Figure 5:
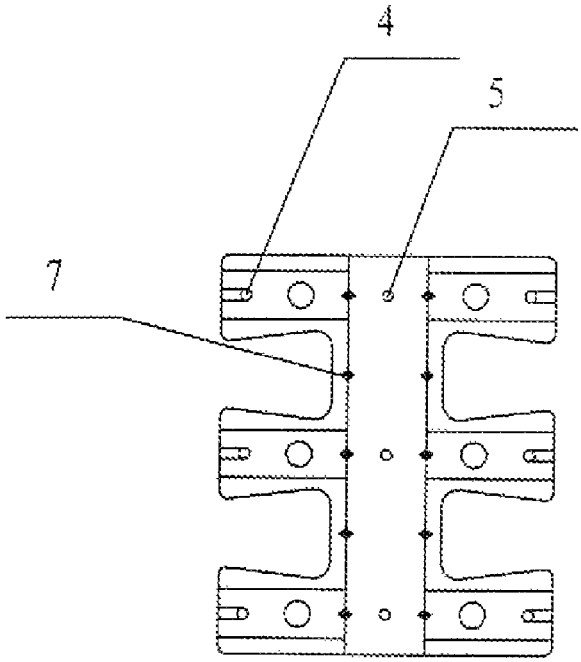
FIG. 5 illustrates a multi-angle projection view of a steel plate in accordance with one embodiment of the present invention.

The side boards of the steel plate are teeth-shaped. The smallest distance between two teeth on the same side board of the steel plate is not less than 15 mm to ensure the integral rigidity of each steel plate. A plurality of main board cavities 5 are vertically distributed in a certain distance along the middle portion of the main board of each steel plate and serve to accept rivets for affixing the steel plates to the prefabricated form panels. A jointing cavity 4 is formed on the protruded portion of each side board of said steel plate. With reference to FIGS. 4 and 5, a plurality of stiffening ribs 7 is disposed on the edges joining the side boards and the main board of the steel plate, and said stiffening ribs physically connect said the side boards with the main board of the steel plate.

The horizontal spacing between two steel plates within the same panel is preferably less than 600 mm. The shortest distance from a steel plate closest to an edge of a form panel to that edge is preferably less than 300 mm. The height of each steel plate is slightly lower than the height of the form panel. The distance from the bottom surface and the top surface of the steel plate to the bottom edge and top edge of the form panel, respectively, is preferably less than 50 mm.

A method of manufacturing a composite thermally-insulated concrete wall moduli comprises: (a) sketching out the borderline of the wall on the foundation (support surface); (b) aligning the outer surface of each form panel with the sketched borderline; (c) stacking the form panels upwards as needed based on the overall desired height of the wall; (d) interconnecting panels by a plurality of jointing pieces and interconnecting the jointing pieces by a plurality of transverse and vertical connecting locks; (e) optionally, installing a supporting modulus at the outside of the outer surface of each form panel; (f) optionally, checking and adjusting, if necessary, the perpendicularity of the form panels after the installation is completed; (g) pouring concrete into spaces formed between adjacent wall panels to form the wall, as well as to combine the concrete wall with the wall form panels; and (h) optionally removing the supporting modulus after a desired strength of the concrete wall is achieved.

The wall form panel modulus is manufactured for on-site assembly and pouring of the concrete, the modulus comprising a pair of single side form panels made of thermally-insulating polystyrene material, a plurality of jointing pieces, and a plurality of fixing pieces. A plurality of steel plates are embedded in each single side form panel, which serves to connect the steel plates with the jointing pieces so as to interconnect the form panels. A plurality of main board cavities 5 are also formed at certain positions of each steel plate, which serve to accept rivets and to fasten the inner and outer decorative layers of the wall to the form panels.

A set of wall form panels are assembled by connecting pairs of single side form panels by a plurality of jointing pieces 6, wherein the thickness of the wall is adjusted by the length of the jointing pieces. Two kinds of available connecting locks, namely the transverse connecting locks 8 and the vertical connecting locks 9, serve to interconnect the jointing pieces.

Figure 6:
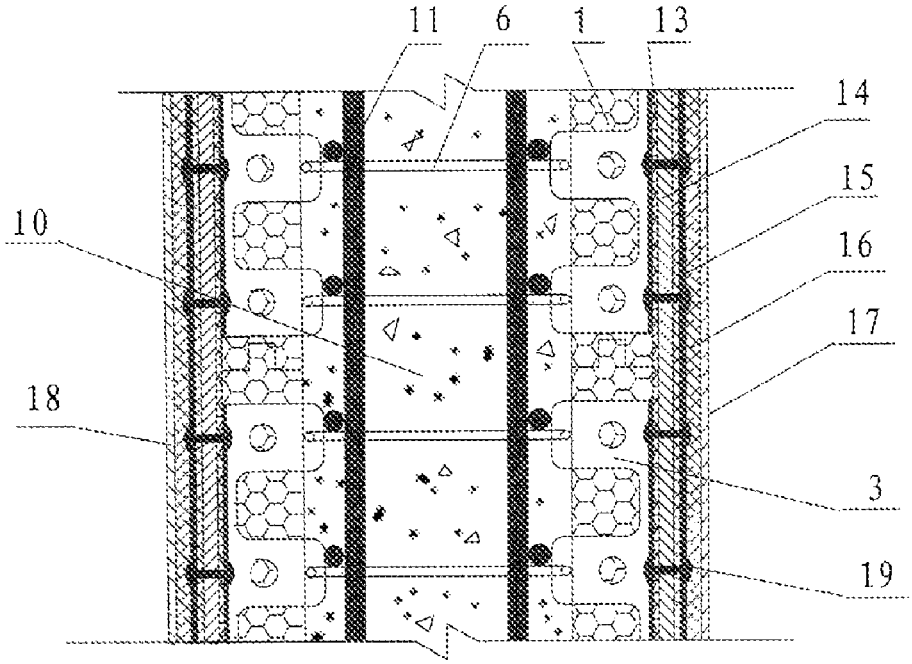
FIG. 6 illustrates a cross-sectional view of a composite thermally-insulated concrete wall plate in accordance with one embodiment of the present invention.

With reference to FIG. 6, a plurality of steel mesh plates 11 is disposed between the prefabricated form panels prior to pouring concrete inbetween the panels. After the concrete has been poured, the prefabricated form panels remain in place (in contact with the concrete wall) to serve directly as the inner and outer thermal insulation layers of the wall.

Further, with reference to FIG. 6, the following reinforcing layers are attached to the outer surface of the wall form panels: a layer of self-adhesive fiber cloth 13; a first layer of cement mortar 14 brushed or sprayed to the outer surface of the self-adhesive fiber cloth; a layer of metal mesh 15 fixed at the position of the main board cavities on the steel plates by a plurality of rivets 19; and a second layer of cement mortar 16 brushed or sprayed to the outer surface of the metal mesh. The cement mortar is a polymer cement mortar or a fiber cement mortar. An outer-facing layer 17 and an inner-facing layer 18 are attached to the outer surface of the reinforcing layers of the wall form panels.

Figure 7:
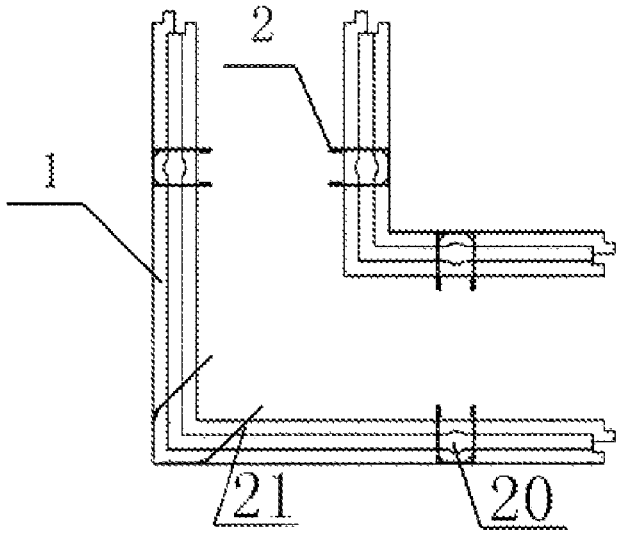
FIG. 7 illustrates a 90° corner form panel in accordance with one embodiment of the present invention.

With reference to FIG. 7, a plurality of steel plates 2 are disposed within the wall form panels, and a pair of 135°-angle steel plates 21 arranged in parallel are disposed at each corner position of the outer form panels, wherein the main board of each 135°-angle steel plate is coplanar with the outer surface of the outer form panel, the two side boards comprise teeth protruding from the inner surface of the outer form panel and embedded within the poured concrete.

Figure 8:
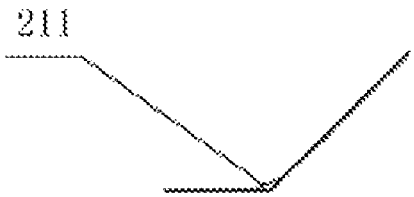
FIG. 8 illustrates a top view of a 135°-angle steel plate in accordance with one embodiment of the present invention.
Figure 9:
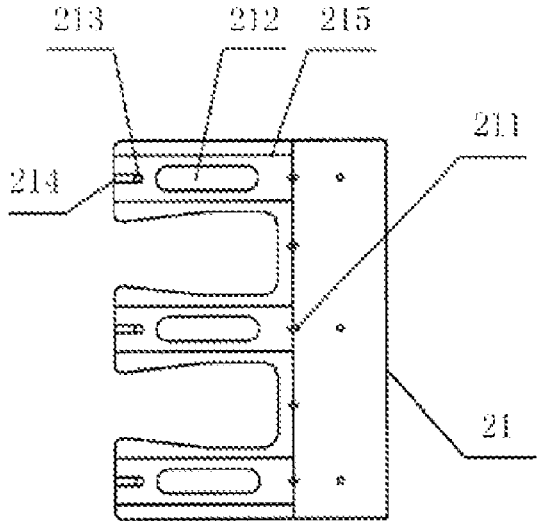
FIG. 9 illustrates a multi-angle projection view of a 135°-angle steel plate in accordance with one embodiment of the present invention.

With reference to FIGS. 8-9, a plurality of cavities 212 and pulling holes 213 are formed in each 135°-angle steel plate, wherein the cavities are disposed in the inner surface of the form panel, the hooks at both ends of the jointing pieces are passed through the two corresponding pulling holes in the teeth of the 135°-angle steel plates so as to interconnect the inner and outer form panels. A plurality of stiffening ribs 211 is reinforces each 135°-angle steel plate 21. A small raised profile 214 is disposed outwardly and adjacent to the pulling hole on each tooth of the steel plate. A big raised profile 215 is disposed transversely on each tooth.

Figure 10:
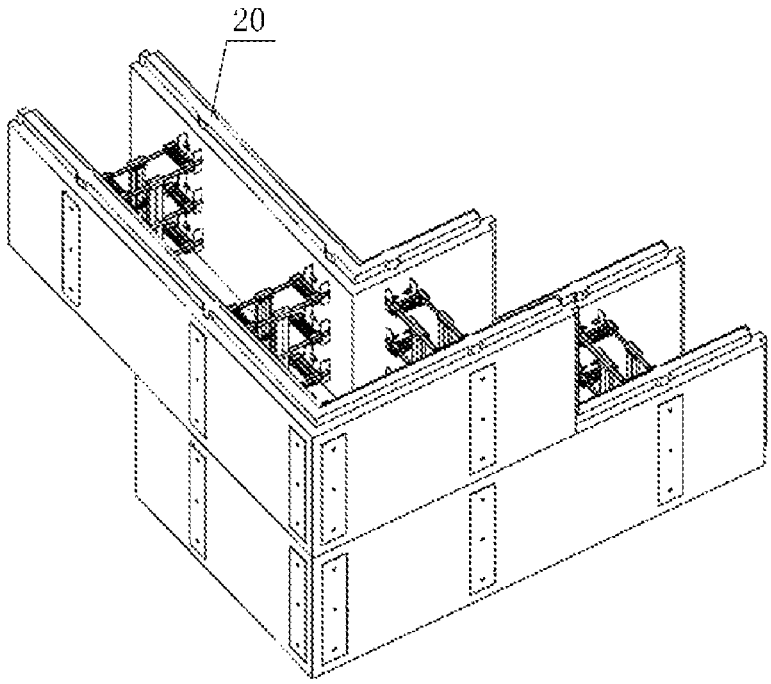
FIG. 10 is a perspective view of an assembly of 90° corner form panels in accordance with one embodiments of the present invention.

With reference to FIG. 10, the inner wall form panels and the outer wall form panels are interconnected by a plurality of jointing pieces so as to form a set of 90° corner form panels.

Optionally, the wings of the form panels have the same or different lengths. The side surfaces between the two inner form panels and those between two outer form panels are joined together by means of tenons and mortises. Fixing tenons are formed on the top and bottom edges of the inner and outer form panels. A plurality of variable cross-sectional anchor points 20 are formed on the fixing grooves at the positions corresponding to the steel plates and serves to position the steel plates in the upper and lower form panels.

Figure 11:
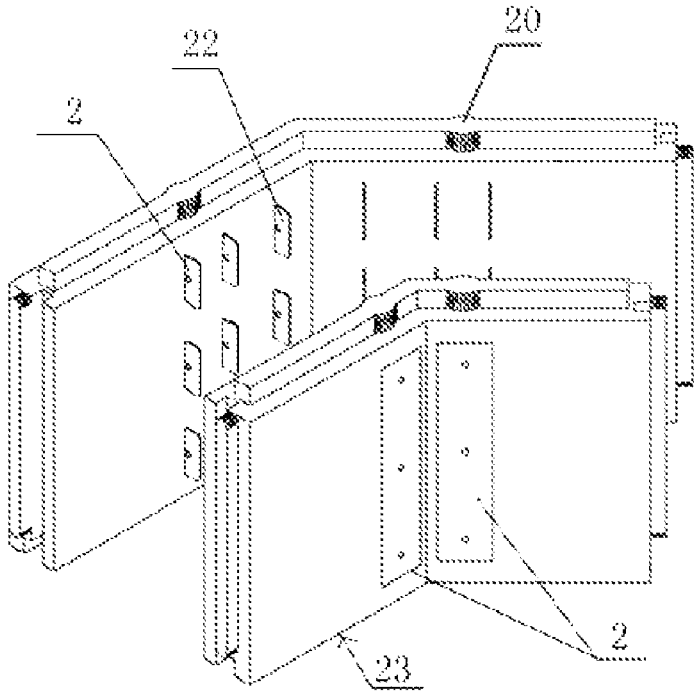
FIG. 11 illustrates a perspective view of a 135° angle form panel in accordance with one embodiment of the present invention.

FIG. 11 shows a 135°-angle form panel 23 of a composite thermally-insulated concrete wall comprising a 135°-angle inner form panel and a 135°-angle outer form panel arranged in parallel to one another. The form panels are preferably made of thermally-insulated polystyrene material. A plurality of steel plates 2 are pre-embedded at predetermined intervals in the inner and outer form panels with the side boards protrude thereout for interconnecting the form panels. A plurality of corner steel plates 22 are embedded at the corners of the inner and outer form panels and are arranged opposite to each other.

Figure 12:
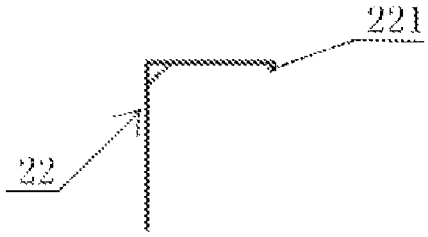
FIG. 12 illustrates a plan top view of a 90° angle steel plate in accordance with one embodiment of the present invention.

With reference to FIG. 12, a plurality of stiffening ribs is disposed at predetermined intervals at the angular position of a 90°-angle steel plate 22, a plurality of hook edges 221 is formed at a surface of each steel plate 22 which surface is coplanar with the outer surface of the outer form panel.

Figure 13:
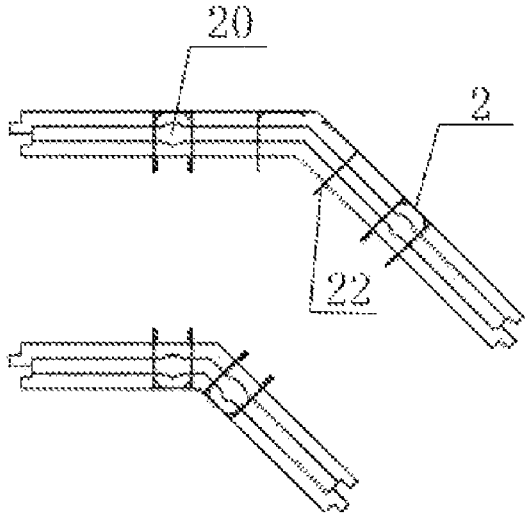
FIG. 13 illustrates a transverse cross-sectional view of a 135°-angle form panel in accordance with one embodiment of the present invention.

With reference to FIG. 13, the thickness of the wall is adjusted by the length of the jointing pieces and the length of one side of the 135°-angle form panel while keeping the length of the other side fixed. The steel plates 2, 22 embedded in the inner and outer form panels are arranged to be opposite to each other so as to satisfy the requirements of the assembly. Optionally, the wings of the form panels can have the same or different lengths.

Figure 14:
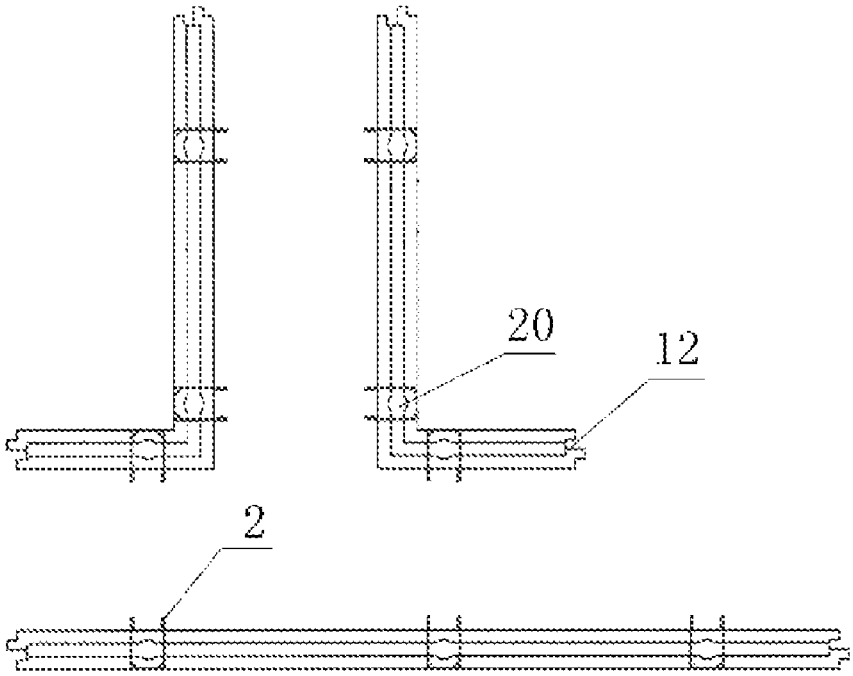
FIG. 14 illustrates a transverse cross-sectional view of an outer form panel of a "T" shaped concrete wall in accordance with one embodiment of the present invention.

With reference to FIG. 14, a "T"-shaped form panel of a composite thermally-insulated concrete wall comprises a pair of asymmetrical 90°-angle form panels and an outer straight form panel. Fixing tenons 12 are formed on the top and bottom edges of the inner and outer form panels. A plurality of circular anchor points 20 are formed on the fixing tenons at the positions corresponding to the steel plates 2 and serve to position the steel plates on the upper and lower form panels. Preferably, the length of a form panel is more than D+200 mm, wherein D is the thickness of the concrete wall.

Figure 15:
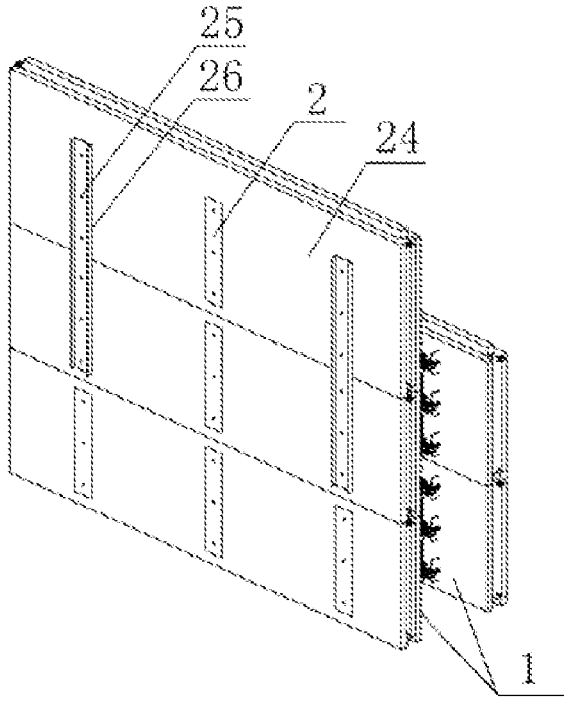
FIG. 15 illustrates a perspective view of an assembly of form panels of a straight wall in accordance with one embodiment of the present invention.

With reference to FIG. 15, a straight wall form panel 24 is fastened with its upper and lower adjacent form panels by a plurality of thin C-shaped steel plates 26 and rivets 25. The assembly strength of the form panels must be guaranteed to resist the impact of concrete pouring. Concrete is poured into the spaces between the straight wall form panels and the slab form panels. The height of the straight form panels varies according to the required height of the slab form panels so as to obtain the right building structure.

Figure 16:
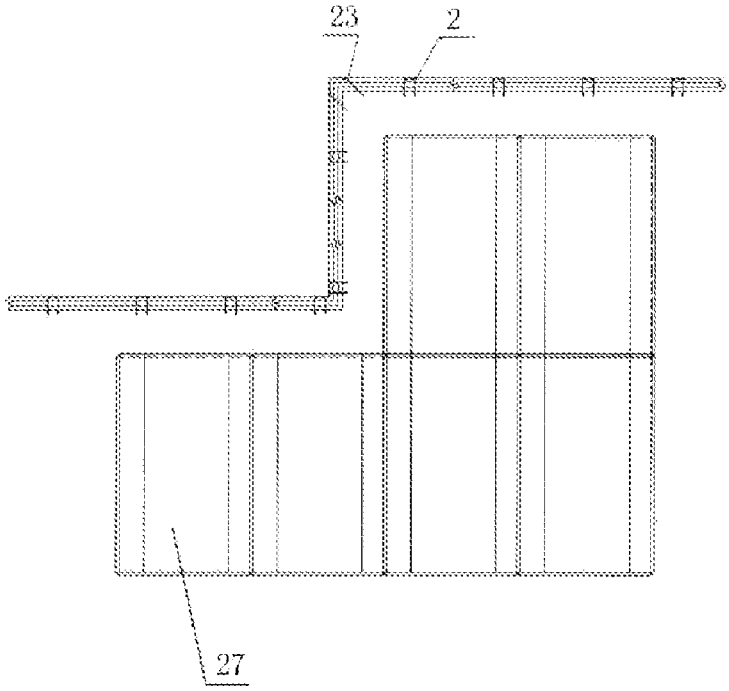
FIG. 16 illustrates a top view of an assembly of 90° wall form panels in accordance with one embodiment of the present invention.
Figure 17:
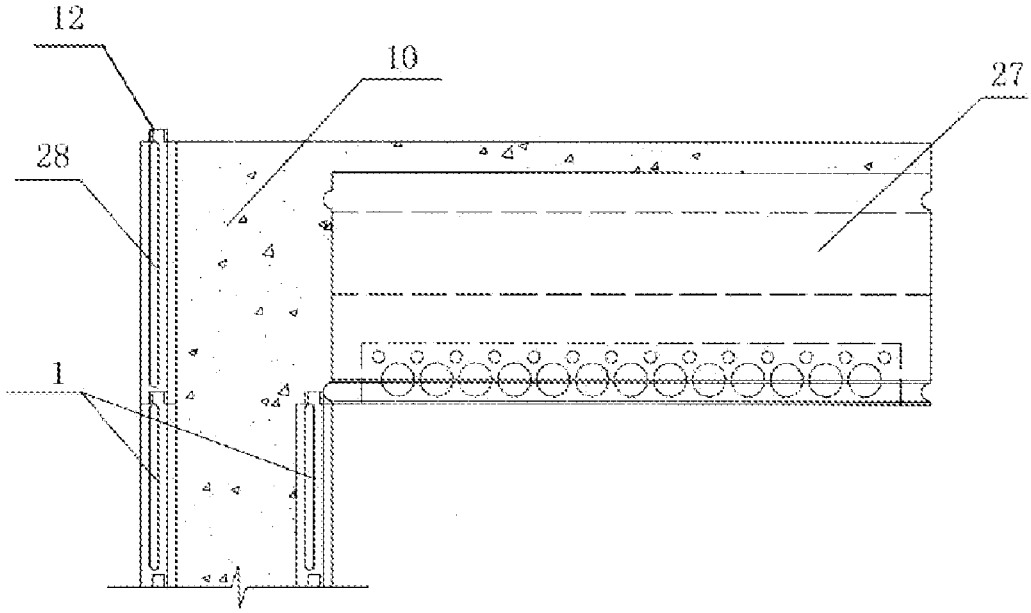
FIG. 17 illustrates a longitudinal cross-sectional view of 90° side form panels together with slab form panels in accordance with one embodiment of the present invention.

With reference to FIGS. 16-17, a 90° form panel 28 is assembled beside a slab form panel 27. Optionally, the 90° form panel can have external and internal angles, and is pre-embedded with a plurality of steel plates 2 and 135°-angle steel plates 23. Concrete is poured into the space between the 90° side form panel 28 and the slab form panel 27. The 90° side form panel 28 is fastened to upper and lower form panels adjacent to it via the fixing tenons 12 being a part thereof.

Figure 18:
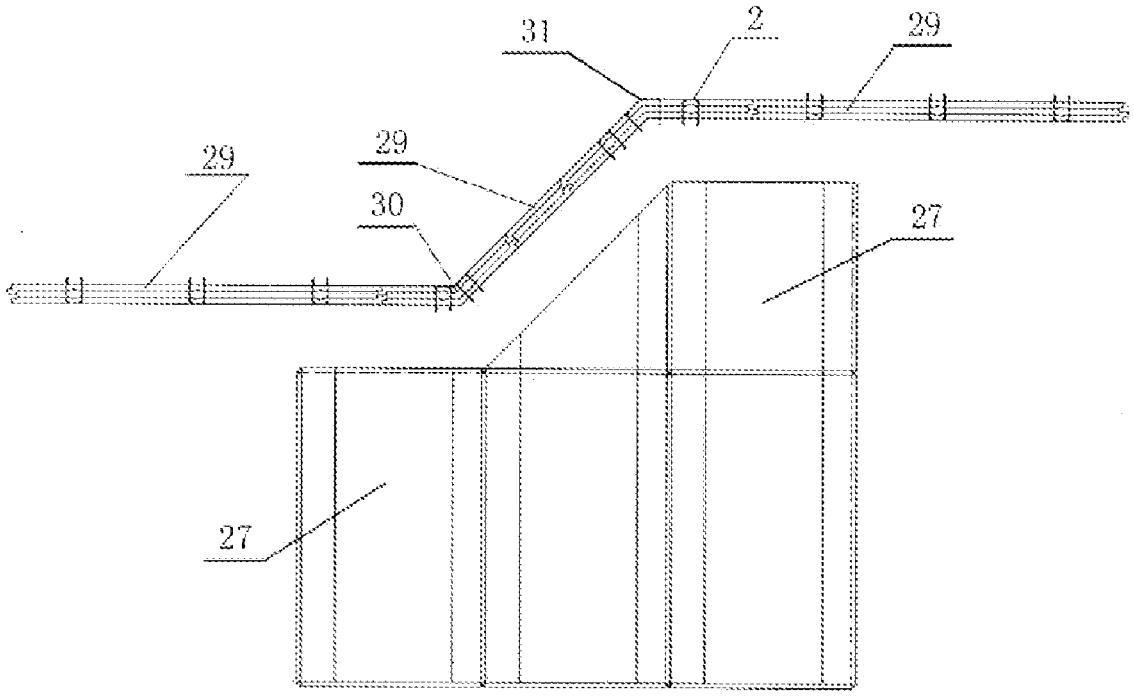
FIG. 18 illustrates a transverse cross-sectional view of an assembly of 135° side form panels in accordance with one embodiment of the present invention.

With reference to FIG. 18, a 135° side form panel 29 of a composite thermally-insulated concrete wall is assembled in proximity to a slab form panel 27. Optionally, the 135° side form panel 29 has internal and external angles 30, 31, and comprises a plurality of steel plates 2.

Figure 19:
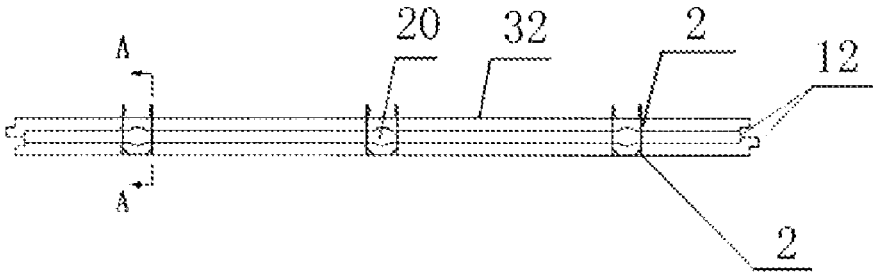
FIG. 19 illustrates a top cross-sectional view of side form panels at a balcony raising position in accordance with one embodiment of the present invention.
Figure 20:
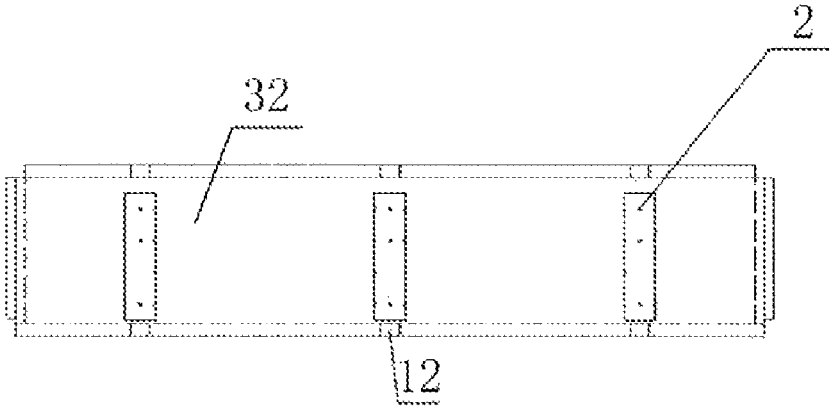
FIG. 20 is a side view of FIG. 1 in accordance with one embodiment of the present invention.

With reference to FIGS. 19-20, a side form panel 32 at the balcony raising position of a composite thermally-insulated concrete wall is a rectangular board made of thermally-insulated polystyrene material with a plurality of steel plates embedded therein and having a "⊏"-shaped cross section. The main board of the steel plate is coplanar with one surface of the form panel, while the two side boards comprise teeth protruding out of the inner surface of the form panel. The side edges and the top and bottom edges of the form panels comprise fixing tenons 12 for interconnecting one form panel to another. A plurality of circular cross-sectional anchor points 20 are formed on said fixing tenons at positions corresponding to the steel plates 2. To exemplify, a balcony side form panel has the dimensions of 120×60×250 mm (length×width×height).

Figure 21:
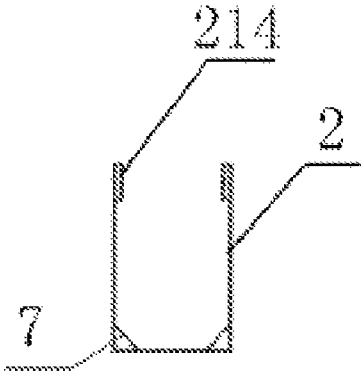
FIG. 21 illustrates a top view of a steel plate in accordance with one embodiment of the present invention.
Figure 22:
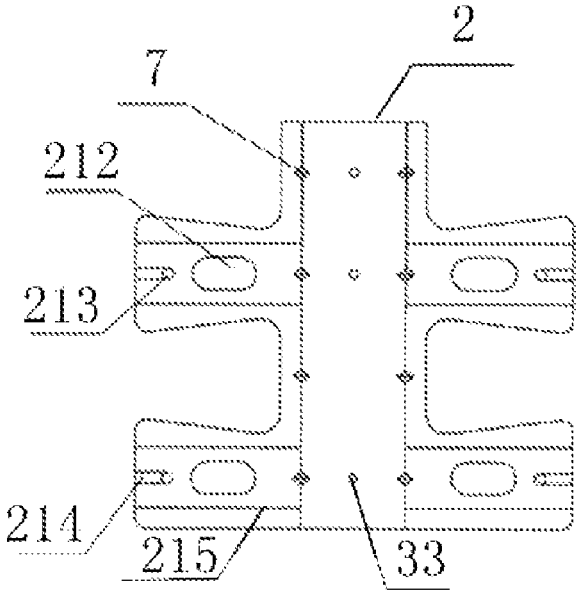
FIG. 22 illustrates a multi-angle projection view of a steel plate in accordance with one embodiment of the present invention.
Figure 23:
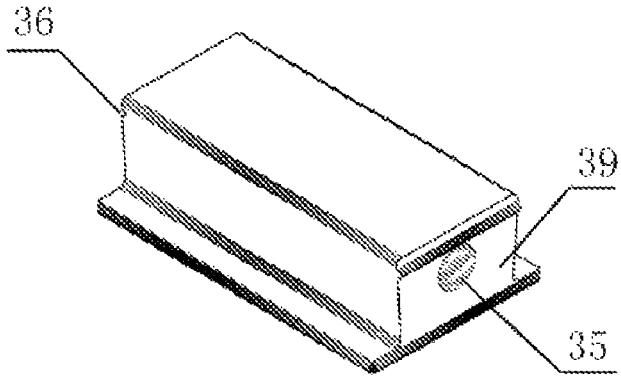
FIG. 23 illustrates a projection view of a composite thermally-insulated concrete slab form panel in accordance with one embodiment of the present invention.
Figure 24:
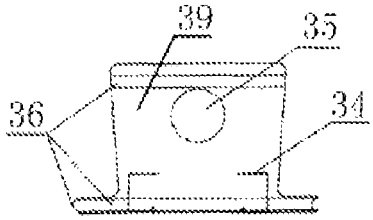
FIG. 24 illustrates a front cross-sectional view of a composite thermally-insulated concrete slab form panel in accordance with one embodiment of the present invention.

With reference to FIGS. 21-22, a plurality of stiffening ribs 7 is disposed at predetermined intervals at the corners of each steel plate. A cavity 212 and a pulling hole 213 are formed on each tooth. A big raised profile 215 is incorporated along the protruding portion of each tooth. A small raised profile 214 is incorporated outwardly adjacent to the pulling hole. A plurality of hanger holes 33 are disposed at certain positions of the steel plate 2 and serve to hang and lift the subject plates.

With reference to FIGS. 23-27, the side surfaces of a composite thermally-insulated concrete slab form panel 27 are tilted outwardly; this is to say that the width of the bottom edge is slightly smaller that the width of the top edge of the form panel 27. The bottom surface of the rectangular board is prolonged at both sides to form a double-wing board (lip) having concave and convex grooves 36 formed on the side edges and having a protruding length which is lower than the height of the board. A pair of drilled "⊏"-shaped thin steel plates 34 are disposed within the thermally-insulated polystyrene foam material along the lower portion of the board, wherein the openings of the thin steel plates 34 are opposed to each other, one side board of each steel plate is coplanar with a bottom surface of the form panel, while the other side board is slightly higher than the height of the wing board (lip).

The side board of the "⊏"-shaped steel plate 34 coplanar with the bottom surface of the form panel provides fixing points for the facing surfaces, utility pipelines or other subjects required to be hanged on the slab. Optionally, a passage 35 at the middle portion of the form panel can be a single-pore passage or a double-pore passage, and serves mainly for installing pipelines for vents or other purposes. The size of the passage, and the distance of the passage to the top surface of the form panel in which the passage is formed are kept constant throughout the panel. The peripheral edges of each form panel comprise grooves 36 for interconnecting one form panel to another. Besides improving the interconnecting performance between the form panels, the groove at the top peripheral edge of the slab also serves to prevent the passage 35 from being blocked by the leaked mortar during the concrete pouring process.

Figure 25:
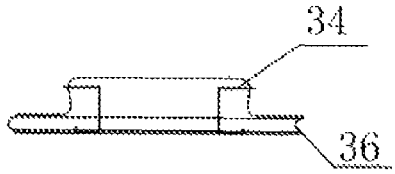
FIG. 25 illustrates a front view of a composite thermally-insulated concrete slab form panel in accordance with another embodiment of the present invention.
Figure 26:
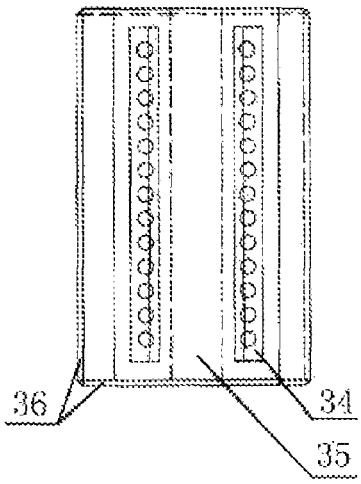
FIG. 26 is a top cross-sectional view a composite thermally-insulated concrete slab form panel illustrated in FIG. 24.
Figure 27:
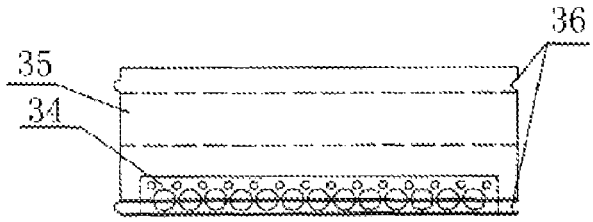
FIG. 27 is a side cross-sectional view a composite thermally-insulated concrete slab form panel illustrated in FIG. 24.

With reference to FIG. 25, in accordance with certain embodiments of the present invention, the passage 35 as well as the groove at the top peripheral edge of the form panel are eliminated when the height of the form panel is too low to accommodate them. The openings of the two drilled "⊏"-shaped thin steel plate are with their backs to each other, wherein the top peripheral edge of the steel plate protrudes out of the side surfaces of the form panel and is embedded in the poured concrete so as to improve the anti-deformatatory properties of the form panels.

Figure 28:
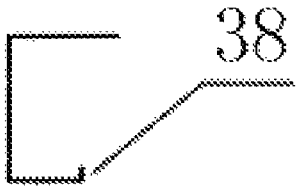
FIG. 28 is a font view of a drilled "⊏"-shaped thin steel plate in accordance with one embodiment of the present invention.
Figure 29:
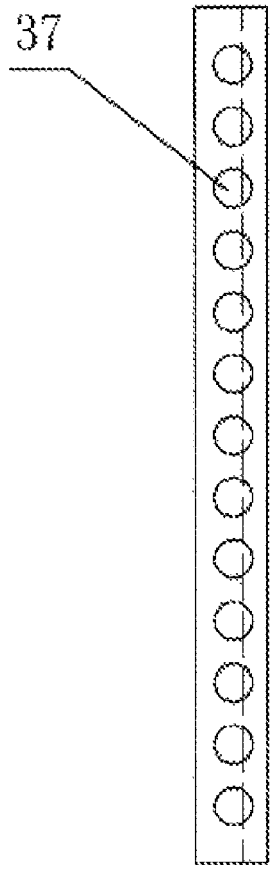
FIG. 29 is a top view of a drilled "⊏"-shaped thin steel plate illustrated in FIG. 28.
Figure 30:
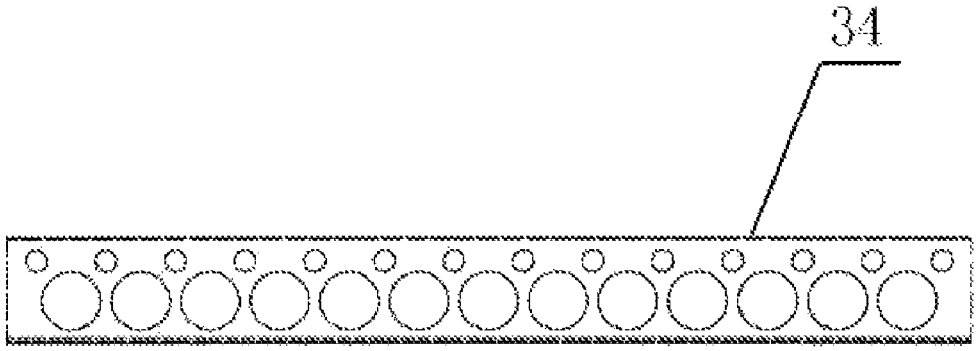
FIG. 30 illustrates a side view of a drilled "⊏"-shaped thin steel plate illustrated in FIG. 28.

With reference to FIGS. 28-30, a plurality of holes 37 are drilled at the top or side surface of a "⊏"-shaped thin steel plate 34, and are particularly in the form of single-row round holes or double-row staggered round holes. Each steel plate 38 comprises a main board and two side boards. The top side board is wider than the bottom side board. A small hook edge 38 is formed on the peripheral edge of the bottom side board.

In accordance with the requirements of a building structure, form panels with different cross sections can be applied to construct slabs with different spans. To exemplify, a form panel having a height of 380 mm can be applied to construct a slab having a span below 8 m; a form panel having a height of 250 mm can be applied to construct a slab having a span below 6 m.

The polystyrene thermal insulation material in accordance with the present invention is preferably made of high-density polystyrene foam having a density of about 30 kg/m$^3$.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

All publications and patent applications mentioned in this specification are indicative of the level of skill of those skilled in the art to which this invention pertains, and are incorporated herein by reference to the same extent as if each individual publication or patent application mentioned in this specification was specifically and individually indicated to be incorporated by reference.

What is claimed is:

1. A concrete wall modulus comprising:

a concrete-steel wall having one or more steel mesh plates;

at least two form panels being physically connected to said concrete-steel wall;

a plurality of steel plates; and a plurality of jointing pieces;

wherein said form panels are made in part of polystyrene foam;

at least two said form panels are arranged in parallel to one another;

at least two said form panels are interconnected by a plurality of said jointing pieces by means of said steel plates;

said steel plates comprise each a main board and two side boards, said side boards having a plurality of teeth and a jointing cavity disposed on each said tooth;

said jointing pieces pass through said jointing cavities;

said jointing pieces are interconnected by a plurality of transverse and vertical connecting locks; and said transverse connecting lock is rod-shaped having two grooves at positions corresponding to the two jointing pieces to be joined.

2. The modulus of claim 1, wherein said main board is coplanar with a surface of said form panel; and said side boards protrude out of said form panel.

3. The modulus of claim 2, wherein said side boards protrude out of said form panel to a distance of not less than 15 mm.

4. The modulus of claim 1 wherein said form panels serve as thermal insulation layers.

5. The modulus of claim 1 wherein said steel mesh plates are disposed between said form panels.

6. The modulus of claim 1 wherein said steel mesh plates are physically connected to said form panels by concrete.

7. The modulus of claim 1 wherein said form panels further comprise tenoned peripheral edges.

8. The modulus of claim 1 wherein the length of each of said form panels is between about 900 and about 1500 mm, the height of each of said form panels is between about 250 and about 600 mm, and the thickness of each of said form panels is between about 40 and about 60 mm.

9. The modulus of claim 1 wherein said steel plates have a "Π"-shaped or "U"-shaped cross section.

10. The modulus of claim 9 further comprising a plurality of stiffening ribs, wherein said stiffening ribs physically connect said side boards with said main board of the steel plate.

11. The modulus of claim 1 wherein said steel plates further comprise a plurality of main board cavities adapted for receiving rivets which main board cavities are distributed along said main board of said steel plates.

12. The modulus of claim 1 wherein each said jointing piece is of "]"-shape and has a curved hook at each of its ends.

13. The modulus of claim 1, further comprising a plurality of anchor points wherein said form panels are selected from the group consisting of 90° form panels, straight wall side form panels, 135°-angle side form panels, and balcony raising side form panels; and/or said steel plates are 135°-angle steel plates.

14. A method of manufacturing a composite thermally-insulated concrete wall modulus of claim 1 comprising:

(a) sketching out an outline of the wall modulus on a support surface;

(b) aligning one or more form panels with said outline;

(c) stacking one or more panels on top of the panels aligned with said outline in step (b) based on the overall desired height of the wall;

(d) interconnecting said panels by a plurality of jointing pieces and interconnecting the jointing pieces by a plurality of transverse and vertical connecting locks;

(e) optionally, installing panel supports at the outside of the outer surface of each form panel;

(f) optionally, checking and adjusting the angles of orientation of the form panels;

(g) pouring concrete into spaces formed between adjacent wall panels; and (h) optionally removing said panel supports after a desired strength of the concrete wall is achieved.

15. A concrete wall modulus comprising:

a concrete-steel wall having one or more steel mesh plates;

at least two form panels being physically connected to said concrete-steel wall;

a plurality of steel plates; and a plurality of jointing pieces;

wherein said form panels are made in part of polystyrene foam;

at least two said form panels are arranged in parallel to one another;

at least two said form panels are interconnected by a plurality of said jointing pieces by means of said steel plates;

said steel plates comprise each a main board and two side boards, said side boards having a plurality of teeth and a jointing cavity disposed on each said tooth;

said jointing pieces pass through said jointing cavities;

said jointing pieces are interconnected by a plurality of transverse and vertical connecting locks; and said vertical connecting lock is rod-shaped having a plurality of grooves at positions corresponding to the jointing pieces to be joined.

16. The modulus of claim 15, wherein said main board is coplanar with a surface of said form panel; and said side boards protrude out of said form panel.

17. The modulus of claim 16, wherein said side boards protrude out of said form panel to a distance of not less than 15 mm.

18. The modulus of claim 15 wherein said form panels serve as thermal insulation layers.

19. The modulus of claim 15 wherein said steel mesh plates are disposed between said form panels.

20. The modulus of claim 15 wherein said steel mesh plates are physically connected to said form panels by concrete.

21. The modulus of claim 15 wherein said form panels further comprise tenoned peripheral edges.

22. The modulus of claim 15 wherein the length of each of said form panels is between about 900 and about 1500 mm, the height of each of said form panels is between about 250 and about 600 mm, and the thickness of each of said form panels is between about 40 and about 60 mm.

23. The modulus of claim 15 wherein said steel plates have a "Π"-shaped or "U"-shaped cross section.

24. The modulus of claim 23 further comprising a plurality of stiffening ribs, wherein said stiffening ribs physically connect said side boards with said main board of the steel plate.

25. The modulus of claim 15 wherein said steel plates further comprise a plurality of main board cavities adapted for receiving rivets which main board cavities are distributed along said main board of said steel plates.

26. The modulus of claim 15 wherein each said jointing piece is of "]"-shape and has a curved hook at each of its ends.

27. The modulus of claim 15, further comprising a plurality of anchor points wherein said form panels are selected from the group consisting of 90° form panels, straight wall side form panels, 135°-angle side form panels, and balcony raising side form panels; and/or said steel plates are 135°-angle steel plates.

* * * * *